US010307923B2

(12) United States Patent
Psimadas et al.

(10) Patent No.: US 10,307,923 B2
(45) Date of Patent: Jun. 4, 2019

(54) SHAVING BLADE CARTRIDGE AND A SHAVER COMPRISING SUCH SHAVING BLADE CARTRIDGE

(71) Applicant: BIC-VIOLEX SA, Anixi (GR)

(72) Inventors: Ioannis-Marios Psimadas, Vrilissia-Athens (GR); Efthymios Saltas, Nikaia (GR); Ioannis Bozikis, Koukaki (GR)

(73) Assignee: BIC VIOLEX SA, Anixi (GR)

( * ) Notice: Subject to any disclaimer, the term of this patent is extended or adjusted under 35 U.S.C. 154(b) by 0 days.

(21) Appl. No.: 15/537,478

(22) PCT Filed: Dec. 22, 2014

(86) PCT No.: PCT/EP2014/079090

§ 371 (c)(1),
(2) Date: Jun. 19, 2017

(87) PCT Pub. No.: WO2016/101989

PCT Pub. Date: Jun. 30, 2016

(65) Prior Publication Data

US 2017/0348866 A1 Dec. 7, 2017

(51) Int. Cl.
*B26B 21/40* (2006.01)
*B26B 21/22* (2006.01)

(52) U.S. Cl.
CPC ..... *B26B 21/4043* (2013.01); *B26B 21/225* (2013.01); *B26B 21/4012* (2013.01);
(Continued)

(58) Field of Classification Search
CPC ..... B26B 21/4043; B26B 21/4062; B26B 21/225; B26B 21/4018; B26B 21/4025;
(Continued)

(56) References Cited

U.S. PATENT DOCUMENTS 4,663,843 A 5/1987 Savage
4,854,042 A 8/1989 Byrne
(Continued)

FOREIGN PATENT DOCUMENTS

WO 2008023210 A1 2/2008
WO 2014094910 A1 6/2014

OTHER PUBLICATIONS

International Search Report for PCT/EP2014/079090, dated Sep. 23, 2015.

*Primary Examiner* — Ghassem Alie
(74) *Attorney, Agent, or Firm* — Polsinelli PC

(57) ABSTRACT

A shaving blade cartridge and shaver having a shaving blade cartridge including a housing extending longitudinally along a longitudinal axis is provided. The housing includes a top side and a bottom side and front and rear longitudinal sides. Each front and rear longitudinal side extend longitudinally along the longitudinal axis between the top and bottom sides. A primary cutting element is mounted on the housing between the front and rear longitudinal sides. The primary cutting element includes a cutting edge facing forwardly toward the front longitudinal side. A primary cover is located rearward of the primary cutting element, a primary guard is located forward of the primary cutting element, and a trimming element including a trimming edge is mounted on the housing. The trimming element is located forward of the primary cutting element, and the trimming edge faces toward a direction opposite the front longitudinal side.

13 Claims, 4 Drawing Sheets

(52) U.S. Cl.
CPC ..... *B26B 21/4018* (2013.01); *B26B 21/4025* (2013.01); *B26B 21/4062* (2013.01)

(58) Field of Classification Search
CPC ... B26B 21/22; B26B 21/222; B26B 21/4031; B26B 21/4012; B26B 21/565; B26B 21/16; B26B 21/227; B26B 21/165; B26B 21/00; B26B 21/44
USPC ..... 30/34, 50, 346.5, 34.1, 47, 346.57, 527, 30/526, 77, 81, 48, 537, 540; D28/46
See application file for complete search history.

(56) References Cited

U.S. PATENT DOCUMENTS 6,161,288 A * 12/2000 Andrews ..... B26B 21/00 30/50
6,276,061 B1 * 8/2001 Rozenkranc ..... B26B 21/22 30/34.1
8,499,459 B2 * 8/2013 Efthimiadis ..... B26B 21/225 30/34.1
8,533,959 B2 * 9/2013 Davis ..... B26B 21/4043 30/34.1
8,567,068 B2 * 10/2013 Luxton ..... B26B 21/225 30/34.1
8,745,876 B2 * 6/2014 Hage ..... B26B 21/10 30/34.1
2004/0055156 A1 * 3/2004 Brown, Jr. ..... B26B 21/16 30/34.1
2005/0022386 A1 * 2/2005 Macove ..... B26B 21/22 30/50
2005/0039337 A1 2/2005 Pennell et al.
2005/0198837 A1 * 9/2005 Rawle ..... B26B 21/222 30/346.57
2013/0199346 A1 * 8/2013 Psimadas ..... B26B 21/225 83/13
2017/0106549 A1 * 4/2017 Bozikis ..... B26B 21/4043

* cited by examiner

SHAVING BLADE CARTRIDGE AND A SHAVER COMPRISING SUCH SHAVING BLADE CARTRIDGE

CROSS REFERENCE TO RELATED APPLICATION

This application is a National Stage application of International Application No. PCT/EP2014/079090, filed on Dec. 22, 2014, the entire contents of which is incorporated herein by reference.

BACKGROUND

1. Field

The present disclosure relates to shaving blade cartridges and shavers having such shaving blade cartridges.

2. Description of Related Art

Traditionally, a shaving blade cartridge includes a housing, primary blades and a trimming blade. The trimming blade is used to trim sideburns or for similar actions in which a precise shave is needed. Typically, the primary blades and trimming blades are mounted in the housing of the shaving blade cartridge. However, the trimming blades are usually attached to the back of the housing to allow for trimming.

The use of the trimming blades is not especially ergonomic, since the user of the shaver having this type of a shaving blade cartridge must adopt a particular trimming movement and/or trimming position which is different from the shaving movement and/or shaving position in order to use the trimming blade. Actually, the user, in many instances, must flip the shaver in order to trim with regards to a traditional shaving position. Besides, the trimming blade is not always accessible or visible, and can substantially increase the time spent on shaving and trimming. In addition, the razor handle must be adapted to be provided with a finger rest area accessible to the user when using the razor to trim.

The embodiments of the present invention have the objectives to mitigate the drawbacks discussed above. The present shaving blade cartridge is especially easy to use. In addition, the shaving blade cartridge does not lead to any adaptation of the razor handle to which the shaving blade cartridge will be connected. In other words, there is no need to add any specific finger rest area on the razor handle to obtain a precise and comfortable trim and/or shave.

SUMMARY

According to the present disclosure, a shaving blade cartridge may include a trimming element that is located forward of a primary cutting element. The trimming element may include a trimming edge arranged to face in a direction opposite to a front longitudinal side of the shaving blade cartridge housing.

Arranging the trimming edge of the trimming element to face in a direction opposite of the front longitudinal side of the shaving blade cartridge housing allows for a full and constant visibility of the trimmer may be possible. Moreover, the maneuverability of the shaving blade cartridge may be increased, as well as the fluidity of movement of the user. Indeed, the user of the shaver does not have to rotate the whole shaver (and the handle of the shaver) to use the trimming blade, which decrease the time spent on shaving and trimming. Thus, the handle design and gripping features specifically directed to the shaving may also be used for the trimming. Besides, the trimming blade may be visible, which may improve the maneuverability of the shaver. The position of the trimming element may also allow to easily adjust the relative position of the trimming element with respect to the shaving surface.

In particular, the present disclosure is related to a shaving blade cartridge comprising:

- a housing extending longitudinally along a longitudinal axis having a top side and a bottom side opposite to the top side and front and rear longitudinal sides each front and rear longitudinal sides extending longitudinally along the longitudinal axis between the top and bottom sides,
- a primary cutting element mounted on the housing between the front and rear longitudinal sides, said primary cutting element having a cutting edge facing forwardly toward the front longitudinal side,
- a primary cover, located rearward of the cutting element,
- a primary guard, the primary guard being located forward of the primary cutting element and,
- a trimming element, mounted on the housing, said trimming element having a trimming edge.

In some embodiments, a person of ordinary skill in the art might also use one or more of the following features:

- the trimming edge facing toward the bottom side; wherein the trimming edge may be easily integrated in the shaving blade cartridge;
- the primary cover located rearward of the cutting edge;
- the primary guard located forward of the cutting edge;
- the trimming element located between the primary guard and the housing; thereby allowing for good compactness of the shaving blade cartridge;
- the trimming element located under the primary guard; in other words, the trimming element may be located between the primary guard and the bottom side, or under the primary guard and beyond the bottom side;
- the trimming element located under the top side; in other words, the trimming element may be located between the top side and the bottom side, or under the top side and beyond the bottom side;
- the trimming element fitted under the primary guard; wherein the trimming element may be hidden but remains accessible and the shaving blade cartridge may be aesthetic;
- the primary guard includes a plastic material; plastic material reduces the weight of the shaving blade cartridge; plastic material may be easy to manufacture;
- the primary guard includes fins; the fins may allow the skin of the user to stretch and/or guides the hairs to be cut;
- the primary guard may include a metal material; a metal guard reduces friction with the skin which may impact shaving performance;
- the trimming element is may be welded on the primary guard; the welding of the trimming element on the primary guard may make the manufacturing of the shaving blade cartridge easier; the welding may allow for a robust fastening;
- the trimming element may include a trimming blade support and a trimming blade, the trimming blade may include the trimming edge, and the trimming blade may be supported by the trimming blade support; in other words, the trimming blade may be supported by a trimming blade support which may contribute to blade strength; the trimming blade may also be a bent blade wherein, no trimming blade support is needed;

the trimming blade may be welded on the trimming blade support; the welding may allow for a robust fastening;

the shaving blade cartridge may further include a trimming cap, the trimming cap may be located rearward of the trimming edge, the trimming cap and the primary guard may be formed as one piece, the trimming cap and the primary guard may be overmoulded;

the shaving blade cartridge may further include a trimming guard, the trimming guard may be located forward of the trimming edge, the trimming guard may be formed by the housing;

an actuator may define a finger rest area on the shaving blade cartridge, the actuator may be located adjacent to the primary cover;

the actuator may extend from the housing;

the actuator may extend from the top side of the housing until beyond the bottom side of the housing; in other words, the actuator may protrude from the housing and may easily be accessible for the user; for example, the actuator may be a separate part.

The present disclosure may also be directed to a shaver including a handle and a shaving blade cartridge as described above, the shaving blade cartridge may be connected to the handle.

In some embodiments, a person of ordinary skill in the art might also use one or more of the following features:

the shaving blade cartridge includes an actuator defining a finger rest area, the actuator may be located adjacent to the primary cover, and wherein the shaving blade cartridge may be pivotally mounted to the handle between an upper end position, in which the actuator may abut against the handle and a rest position, in which the actuator may be spaced from the handle, or not in contact with the handle;

the actuator may be located on the housing and may extends transversally to the top side toward the bottom side; the position of the actuator may be ergonomic and thereby not disturbing shaving;

a locking device may secure the position of the shaving blade cartridge in the upper end position.

BRIEF DESCRIPTION OF THE DRAWINGS

Other characteristics and advantages of the embodiments of the present disclosure will become readily apparent from the following description and the accompanying drawings, which are provided as non-limitative examples.

BRIEF DESCRIPTION OF THE DRAWINGS

Figure 1:
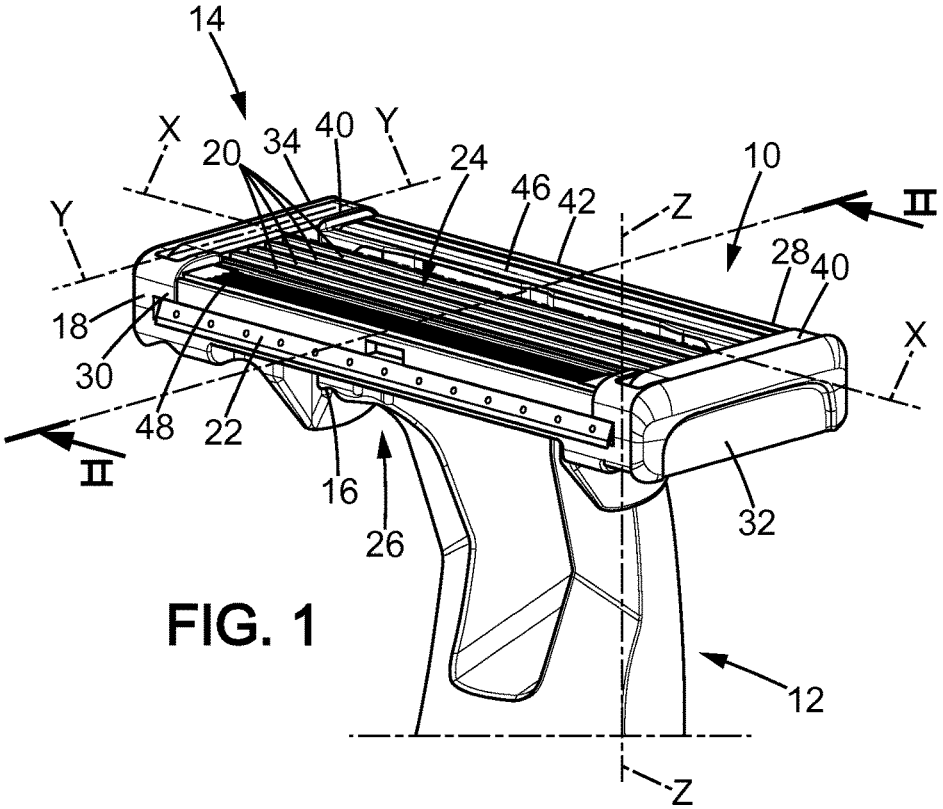

FIG. 1 is a perspective view of a first embodiment of a primary guard of a shaving blade cartridge.

Figure 2:
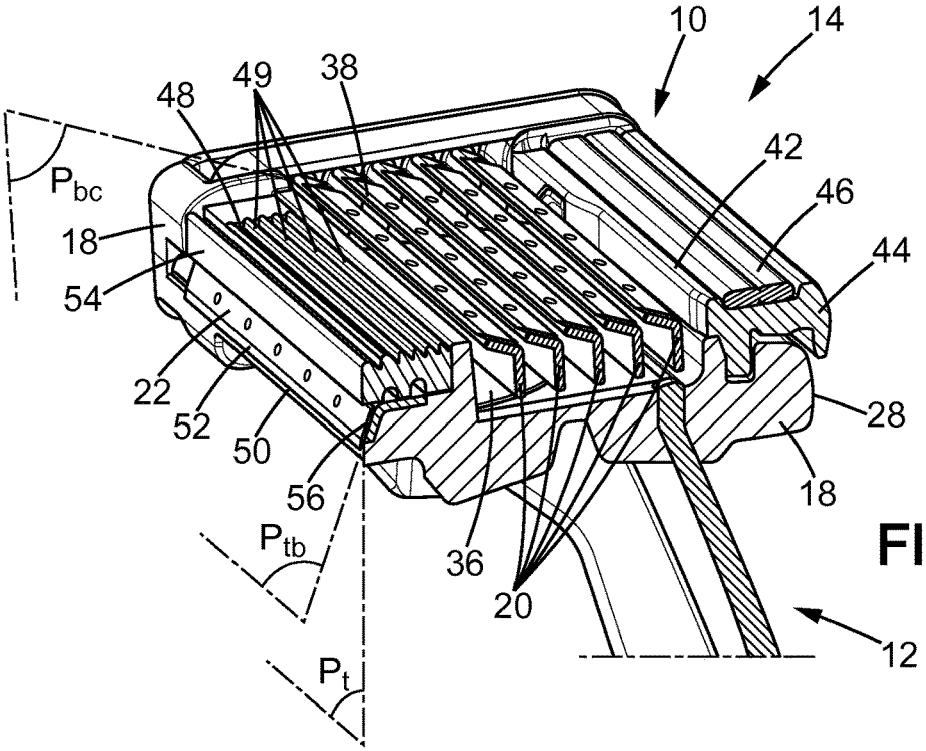

FIG. 2 is a cross view of the shaving blade cartridge of FIG. 1.

Figure 3:
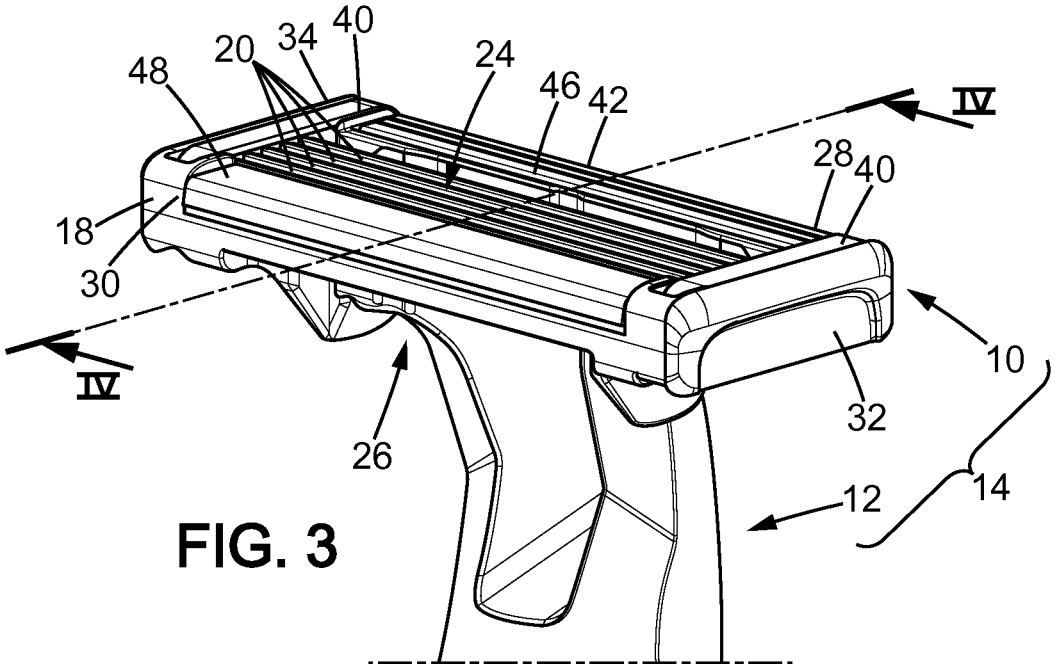

FIG. 3 is a perspective view of a second embodiment of a primary guard of a shaving blade cartridge.

Figure 4:
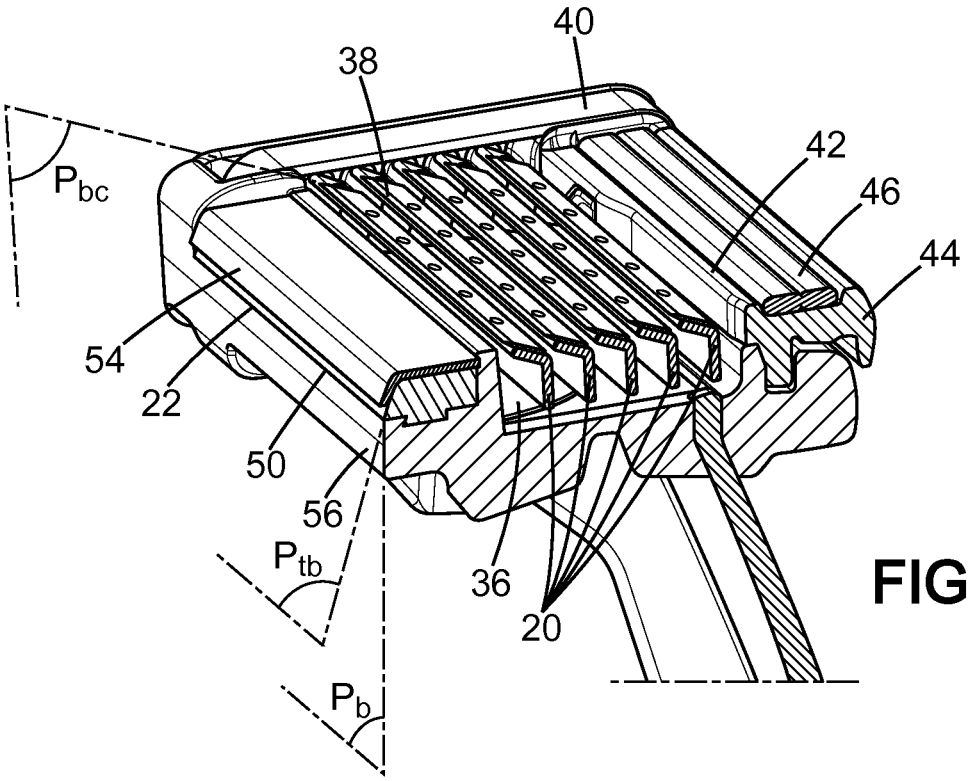

FIG. 4 is a cross view of the shaving blade cartridge of FIG. 3.

Figure 5:
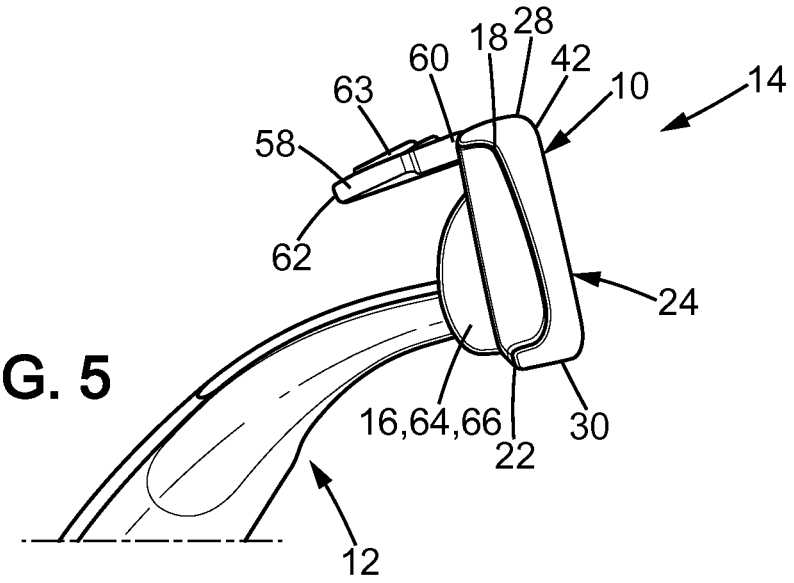

FIG. 5 is a perspective view of the shaving blade cartridge in a rest position.

Figure 6:
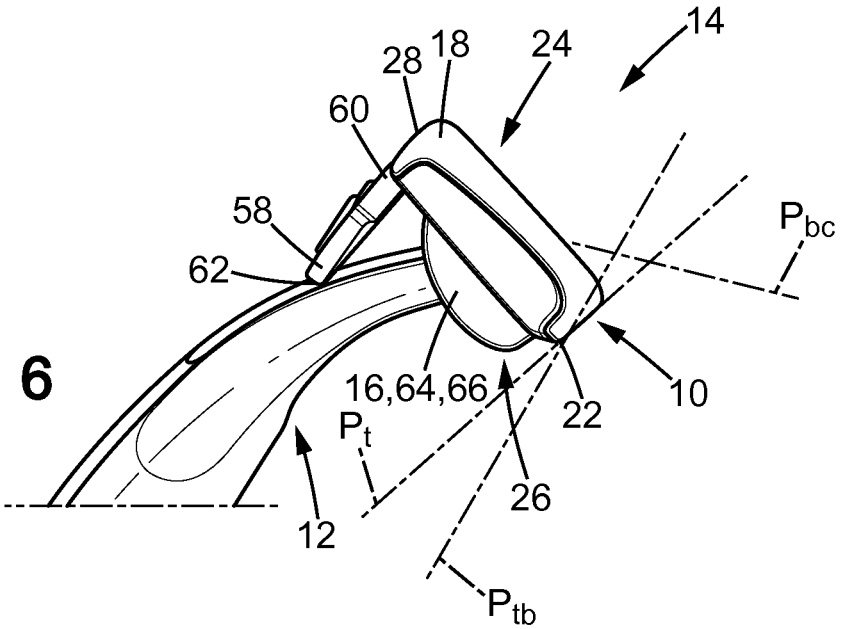

FIG. 6 is a perspective view of the shaving blade cartridge in an upper end position.

Figure 7:
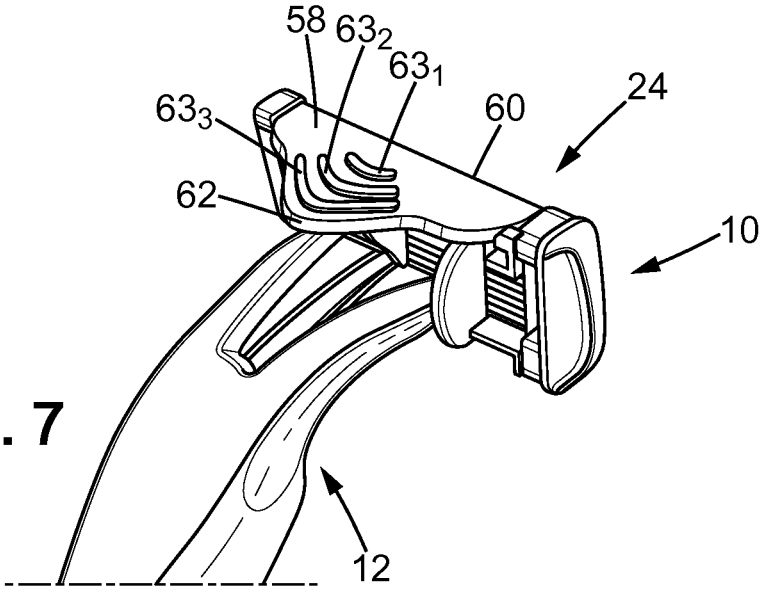

FIG. 7 is a perspective view of an actuator of the shaving blade.

DETAILED DESCRIPTION

FIG. 1 and FIG. 3 depict a shaving blade cartridge 10 according to a first and a second embodiment of the disclosure, respectively. The shaving blade cartridge 10 is attached to a handle 12 to form a wet razor 14 or shaver 14.

The shaving blade cartridge 10 may be non-detachable from the handle or may be releasably connected to the handle 12 through a lock-and-release mechanism 16. The shaving blade cartridge may include a housing 18 which may, for example, include a connection mechanism 16 adapted to connect to the handle 12. The connection mechanism 16 may facilitate the release and/or attachment of the shaving blade cartridge 10 to the handle 12.

The shaving blade cartridge 10 may be provided with one or more cutting elements 20, also called primary cutting elements 20.

The primary cutting elements 20 may not be driven by a motor relative to the shaving blade cartridge 10. The primary cutting elements 20 may be used for usual or traditional shaving, i.e. to cut or remove hairs or beard at the surface of the skin with the razor 14. The shaving blade cartridge 10 may also include a trimming element 22. The trimming element 22 may be a precision element which may allow for a more precise shave. The trimming element 22 may also allow for a better shave of skin areas constricted by adjacent protruding facial features, e.g. skin areas situated under the nose, near the ears, and the same. Thus, the trimming shave may be the shaving of skin areas constricted by adjacent protruding facial features with a trimming element 22.

According to some embodiments, the shaving blade cartridge 10 includes a housing 18. The housing 18 extends along a longitudinal axis X-X. The housing 18 may be a general rectangular shape. However, in some embodiments, the general shape of the housing 18 may be different, and for example the housing 18 could have an oval shape, a square shape, or a circular shape. The housing 18 includes a top side 24, a bottom side 26 opposite to the top side 24, and front and rear longitudinal sides 28, 30, respectively. For example, the bottom side 26 may be adapted to be arranged in front of the handle 12, whereas the top side 24 may be arranged opposite to the bottom side 26. The top side 24 and the bottom side 26 may be parallel to each other.

The front longitudinal side 28 extends along the longitudinal axis X-X. The rear longitudinal side 30 and the front longitudinal side 28 may be facing each other. The rear longitudinal side 30 may be approximately parallel to the front longitudinal side 28, especially when the front and rear longitudinal sides 28, 30 are flat. However, the front and rear longitudinal sides 28, 30 may also have subtle or noticeable opposing inclinations. The front and rear longitudinal sides 28, 30 may also have curved surfaces. The rear longitudinal side 30 may also extend along the longitudinal axis X-X. The front and the rear longitudinal side 28, 30 may each extend in a lateral direction Z along a lateral axis Z-Z, between the top side 24 and the bottom side 26 of the housing 18. The lateral axis Z-Z may intersect the longitudinal axis X-X. For example, the longitudinal axis X-X and the lateral axis Z-Z may be orthogonal to each other.

The housing 18 may also include first and second lateral sides 32, 34 which extend between the front and rear longitudinal sides 28, 30, along a transverse axis Y-Y. The transverse axis Y-Y is perpendicular to the longitudinal axis X-X. The transverse axis Y-Y may be, for example, orthogonal to the longitudinal axis X-X and to the lateral axis Z-Z. The first and second lateral sides 32, 34 may be arranged, in the lateral direction Z, between the top side 24 and the bottom side 26. The first and second lateral sides 32, 34 and the front and rear longitudinal sides 28, 30 may form together the external surface of the housing 18.

The first and second lateral sides 32, 34 both join the longitudinal ends of the front and rear longitudinal sides 28, 30. In a similar way, the front and rear longitudinal sides 28, 30 both join the free ends of the first and second lateral sides 32, 34. The housing 18 may be formed from a plastic material. However, other materials may also be used. For example, the housing 18 may also include a metallic material. Moreover, the housing 18 may be made with a combination of two or more different materials. For example, a part of the housing 18 may be made in a first material, whereas the other part of the housing 18 may be made with a second material.

The housing 18 may also include a blade receiving section 36. The blade receiving section 36 or blade receiving area 36 may have a general rectangular shape. The blade receiving section 36 may be arranged on the top side of the housing 18. The blade receiving section 36 may defines a recess and may be adapted to receive at least one primary cutting element 20. In other words, the shaving blade cartridge 10 may include at least one primary cutting element 20. The primary cutting element 20 (or cutting element 20) may be mounted on the housing 18 between the front and rear longitudinal sides 28, 30.

According to some embodiments, the shaving blade cartridge 10 may include five primary cutting elements 20. However, in other embodiments, the shaving blade cartridge 10 may include more or less than five primary cutting elements 20. For example, the shaving blade cartridge 10 may include three primary cutting elements 20.

The primary cutting elements 20 are mounted in the housing 18 in the blade receiving section 36 between the front and rear longitudinal sides 28, 30 of the housing 18 and between the first and second lateral sides 32, 34 of the housing 18. Each primary cutting element 20 extends longitudinally along a cutting element axis. For example, the cutting element axis may coincide with the longitudinal axis X-X. Each primary cutting element 20 may include a first and second end along the longitudinal axis X-X. The first end of the primary cutting element 20 may be located toward the first lateral side 32 of the housing 18, whereas the second end of the primary cutting element 20 may be located toward the second lateral side 34 of the housing 18. Each primary cutting element 20 may include a cutting edge 38. The cutting edge 38 may extend along a cutting edge axis which may also coincide with the longitudinal axis X-X. The cutting edge 38 of the primary cutting element 20 may be accessible at the top side 24 of the housing 18 to cut hair during the "main' or "primary" shave. The cutting edge axis may define a plane which passes through the cutting edges 38 when the primary cutting elements 20 are at rest (i.e. when no external force is being applied to the primary cutting elements 20).

The primary cutting elements 20 may be L-shaped primary cutting blades 20, as shown in FIGS. 2 and 4. For example, the L-shaped primary cutting blades 20 may include a guided portion, and a bent portion which is intermediate to the cutting edge portion and the guided portion. Thus, the L-shaped primary cutting blades 20 may include the cutting edge 38, guided portion, and a bent portion which may be intermediate to the cutting edge portion and the guided portion. The primary cutting edge portion may extend along a cutting edge portion axis. Advantageously, the cutting edge portion axes of all cutting blades may be positioned parallel to each other.

Each primary cutting blade 20 may be freely mounted in the housing 18. More precisely, the primary cutting blades 20 may be movably mounted in the blade receiving section. Each primary cutting blade 20 may be, for example, supported by two elastic fingers. The elastic fingers may be molded as a single piece with the housing 18 and may extend in the blade receiving section 36 towards each other and upwardly from both lateral sides of the housing 18. As shown on FIG. 2, the guided portions of the primary cutting blades 20 may be slidingly guided in slots provided in the housing 18. For example, the primary cutting blade 20 may be provided with the cutting edge 38 fixed on a blade support which includes the guided portion and the bent portion. In this case, the blade support may be carried by the elastic fingers. In other embodiments, the primary cutting elements 20 may be bent or curved blades.

The primary cutting element 20 may be retained in the housing 18 by a retainer or a clip 40. As shown in FIGS. 1, 2, 3 and 4, the shaving blade cartridge 10 may include two clips 40 for retaining the primary cutting blades 20 in the housing 18. The two clips 40 may be identical. However, the two clips 40 may also be different; for example, they may have different dimensions, different shapes, or different positioning.

The two clips 40, as shown in FIG. 1, each include a first leg, a second leg and a clip body. The clip body may extend between the first and second legs. The clip body, first leg and second leg may form a one-piece part.

As shown in the FIGS. 1 and 3, the first leg of the clip may surround the front longitudinal side 28 of the housing 18, and at least a portion of the bottom side 26 of the housing 18. In other words, a portion of the clip 40 may be wrapped around a portion of the housing 18. The clip body may be arranged facing the top side 24 of the shaving blade cartridge 10. More precisely, the clip body may be facing the cutting edge 38 of the at least one cutting element 20. To avoid any interference with shaving, the clip body may be arranged towards the longitudinal ends of the primary cutting element 20. The clip body may extend along the transversal axis Y-Y.

The second leg of the clip 40 may, for example, be received in a through hole provided in the housing 18. The through hole may extend transversally to the longitudinal axis X-X along the lateral axis Z-Z through the housing 18 between the top side 24 and the bottom side 26. The through hole is neither a slot nor a groove. The through hole extends through the housing 18 and when viewed in transversal cross-sectional view may be laterally surrounded by the material of the housing 18.

The second leg of the clip 40, which may be received in the through hole, and may be bent around at least a portion of the bottom side. The second leg of the clip may extend in a groove provided on the bottom side of the housing 18. For example, the groove for the second leg may be in the continuity of groove(s) provided for the first leg.

According to some embodiments, the shaving blade cartridge 10 may include a primary cover 42. The primary cover 42 may be located rearward of the cutting edge 38. The primary cover 42 may be located toward the front longitudinal side 28. For example, the primary cover 42 may be provided on a rear element 44. The rear element 44 may have a T-shape or U-shape with a leg of the rear element 44 fitted inside the housing 18. The leg may be press-fitted or snap-fitted inside the housing 18. However, in other embodiments, the rear element 44 may be fastened to the housing 18 by others methods or means like glue, overmoulding. The housing 18 may also have a portion which forms the primary cover 42.

The rear element 44 may extend along the longitudinal axis X-X. The rear element 44 may be in plastic material. However, others material or materials combination may be envisioned. For example, the rear element 44 may include metal element or a combination of metal and plastic material.

The primary cover 42 may be, for example, provided with a lubricating strip 46. The lubricating strip 46 may be used during the "main" shaving. The lubricating strip 46 may extend on the top side of the housing 18. The rear element 44 and/or the lubricating strip 46 may be smaller in length along the longitudinal axis X-X than the distance between the two clips 40. However, in an embodiment, the rear element 44 and/or the lubricating strip 46 may be bigger in length along the longitudinal axis X-X than the distance between the two clips 40 so that a portion of the ends of the rear element 44 and/or the lubricating strip 46 may extend under the clips 40.

The shaving blade cartridge 10 may also include a primary guard 48. The primary guard 48 may be located forward of the primary cutting element 20. More particularly, the primary guard 48 may be located forward of the cutting edge 38. The primary guard 48 may be located toward the rear longitudinal side 30. The primary guard 48 may extend along the longitudinal axis X-X.

In the first embodiment, such as represented in FIGS. 1 and 2, the primary guard 48 may include rubber or plastic material. For example, the primary guard 48 may include or may be made of co-injected rubber. For example, the primary guard 48 may not be part of the housing 18. The primary guard 48 may be provided with a shaving aid on it. The primary guard 48, such as depicted in the FIGS. 1 and 2 may be provided with six linear fins 49. The fins may extend along the longitudinal axis X-X. The fins may include rubber. However, in some embodiments the primary guard may be flat without fins or may include non-linear fins. The primary guard may be provided with any manufactured pattern or shape. The fins of the primary guard may have the same elevation. In other embodiments, the fins of the primary guards may have different elevations with respect to the blade plane.

In the second embodiment, such as represented in FIGS. 3 and 4, the primary guard 48 may include a metal material. For example, the primary guard 48 may be rectangular. The primary guard 48 may be smooth. The skin contact area of the primary guard 48 may be entirely made of a metallic material. A special coating may be applied on the plastic guard bar giving a metal aspect to the guard. More precisely, the guard bar may be obtained by the addition of metal plating on a plastic guard bar that will give the metal characteristics. Tests have proven that metal may help improve glideness when comparing the same guard design in multiple materials.

In the first and second embodiments, the primary guard 48 may extend between the two clips 40. More particularly, the primary guard 48 may be smaller in length along the longitudinal axis X-X than the distance between the two clips 40, and may be smaller in length along the longitudinal axis X-X than the distance between the two through holes of the housing 18.

The trimming element 22 may be disposed between the primary guard 48 and the housing 18. In some embodiments, the trimming element 22 may be located below the primary guard 48. The trimming element 22 is may be located forward of the primary cutting element 20 and forward of the cutting edge 38. The trimming element 22 may include a trimming edge 50. The trimming edge 50 may be positioned to face away from the front longitudinal side 28 and may be oriented to extend toward the bottom side 26 of the housing 18. In other words, the trimming edge 50 may face toward the bottom side 26 of the housing 18. The trimming edge 50 may be oriented in a direction that is transverse to the orientation of the cutting edge 38. Hence, the trimming edge 50 and the cutting edge 38 face in different directions. The primary cutting element 20 may include a cutting blade extending in a cutting blade plane Pbc. The trimming element 22 may include a trimming blade 52 extending in a trimming blade plane $P_{tb}$. The trimming blade plane $P_{tb}$ crosses the cutting blade plane $P_{bc}$. For example, the angle provided between the cutting blade plane Pbc and the trimming blade plane $P_{tb}$ may be between 40° and 100°.

The trimming element 22 may be similar to one of the primary cutting element 20. For example, the trimming element 22 may include a trimming blade support and a trimming blade. The trimming blade may include the trimming edge. The trimming blade may be supported by the trimming blade support. For example, the trimming blade may be welded to the trimming support. However, other blades may be used, like bent blades, as described for instance in patent application WO2013/050606, or curved blades.

In an embodiment (not represented), the trimming element 22 may be located below the housing 18. The trimming element 22 may thus extends at the bottom side 26 of the housing 18. For example, the trimming element 22 may be welded at the bottom side 26 of the housing 18. The trimming element 22 may also be riveted on the bottom side 26. In such embodiment, the trimming element 22 may be, for example, a flat unbent blade.

In the second embodiment, depicted in FIGS. 3 and 4, the primary guard 48 including metallic material, the trimming element 22, or the trimming blade may be directly welded to the primary guard 48. For example, in the second embodiment, the trimming element 22 may be provided without any trimming blade support, and the trimming element 22 may be directly fastened to the primary guard 48 comprising metal material.

The primary guard 48 may be fastened to the housing by welding, glue, snap-fitting, press-fitting or others methods, like magnetic methods or with adhesives. For example, the primary guard may include an arm which may be press fitted in the housing. The arm may include a plurality of legs, each of them cooperating with a dedicated recess arranged in the housing 18. Thus, several press fit pairs may be formed, which allows for an increase of the holding pressure of the primary guard 48 into the housing 18. The recesses may also be provided with protrusions to interact with the legs when the primary guard 48 may be pressed into position, the protrusions being permanently deformed when the primary guard is pressed into position.

The shaving blade cartridge 10 may include a trimming cap 54. The trimming cap 54 may be located rearward of the trimming edge 50. The trimming cap 54 and the primary guard 48 may be one piece part. The trimming cap 54 and the primary guard 48 may be mono-bloc. In other words, the primary guard 48 may also have a trimming cap 54 function. In some embodiment, the trimming element 22 may be provided without a trimming cap 54.

The shaving blade cartridge 10 may include a trimming guard 56. The trimming guard 56 may be located forward of the trimming edge 50. The trimming guard 56 may be formed by the housing 18.

The trimming guard 56 and more precisely the leading surface of the trimming guard 56 and the trimming cap 54 may define a trimming plane $P_t$. The trimming element 22 may have a positive, a null or a negative exposure with regard to the trimming plane $P_t$.

The definition of the trimming plane Pt may depend on the shape of the housing 18. In some embodiments, the trimming element 22 may be provided without any trimming cap 54. The trimming plane $P_t$ may then be defined by the plane passing through the surface of the trimming guard 56.

The trimming plane $P_t$ and the trimming blade plane $P_{tb}$ may define together an angle. This angle may be between 10° and 60°, or between 20° and 40° or may be equal to 30°.

The shaving blade cartridge 10 may be further provided with an actuator 58 such as represented in the FIGS. 5 and 6. The actuator 58 may form a precision actuator. The actuator 58 may be provided adjacent to the primary cover 42. The actuator 58 may be located at the front longitudinal side 28. The actuator 58 may extend beyond the bottom side of the housing 18. The actuator 58 may be arranged such that a user may be able to place his/her finger thereon in order to be able to rotate the cartridge by pressing the actuator 58. The user may easily adjust the relative position of the trimming blade with respect to the shaving surface, especially on hard-to-reach areas.

The actuator 58 may include plastic material. The actuator 58 may be overmoulded with the housing 18, or may be a separate part which may be fitted with the housing 18 on the front longitudinal side 28 of the housing 18. The actuator 58 may be a component of the housing 18, may belong to the housing or may be a part which is different of the housing.

The actuator 58 may have the same length along the longitudinal axis X-X than the length of the primary guard 48. The actuator 58 may extend transversally to the top side 24 or bottom side 26 of the housing 18. For example, the actuator 58 extends along the longitudinal axis and along a direction parallel to the lateral axis Z-Z. However, the actuator 58 may extend in a direction which may not be exactly parallel to the lateral axis Z-Z. The actuator may include two lateral ends 60, 62. the first lateral end 60 of the actuator 58 may be fastened to the housing 18 whereas the second lateral end 62 may be free. The actuator 58 may be located on the housing 18 and may extend transversally to the top side 24 toward the bottom side 26.

The actuator 58 may define a finger rest area for a user, as represented in FIG. 7. The actuator may include an extern surface and an intern surface. The intern surface may be facing the handle or the shaving blade cartridge 10. The extern surface may be opposite to the intern surface. The actuator 58 may be provided with a raised pattern 63 on its external surface wherein the raised pattern 63 may be adapted to receive the finger of a user. This raised pattern 63, like ribs or other patterns may have a grip function to avoid any gliding of the finger during the use.

For example, as shown in FIG. 7, the actuator 58 may include three ribs $\mathbf{63}_k$, $\mathbf{63}_2$, $\mathbf{63}_3$. The ribs may have an arc shape. The third rib $\mathbf{63}_3$, directed to the second lateral end 62 may be longer than the first rib $\mathbf{63}_1$ arranged near the first lateral end. The second rib $\mathbf{63}_2$ may be located between the first rib $\mathbf{63}_1$ and the third rib $\mathbf{63}_3$. The second rib $\mathbf{63}_2$ may be longer than the first rib $\mathbf{63}_1$. The third rib $\mathbf{63}_3$ may be longer than the second rib $\mathbf{63}_2$. The distance between two ribs may be of about 2 millimeters (mm). The arc shape of the third rib $\mathbf{63}_3$, seen from the first lateral end 60, may be concave. The arc shape of the second rib $\mathbf{63}_2$ and the first rib $\mathbf{63}_1$, seen from the first lateral end 60, may also be concave. The shape and the spacing of the ribs may allow for a good gripping action.

In an embodiment (not represented), the actuator may include a hole. The finger of the user may be placed centered with regard to the hole.

The shaving blade cartridge 10 may be attached to the handle 12 as depicted in the figures. The handle 12 may extend in a handle 12 direction between a proximal portion and a distal portion. The handle 12 direction may be curved or include one or several straight portions. The handle 12 may pivot with regard to the shaving blade cartridge 10. More particularly, the handle 12 may pivot with regard to the shaving blade cartridge 10 from a rest position, in which the handle 12 or the shaving blade cartridge 10 may be free of constraints toward two opposite directions. In another embodiment, the handle 12 or the shaving blade cartridge 10 may pivot from a rest position toward one sole direction. For example, a pivot mechanism 64 may be located toward the rear longitudinal side 30 and the actuator 58 may be opposite.

As represented in the FIGS. 5 and 6, the shaving blade cartridge 10 may be pivotally mounted to the handle 12 between an upper end position and a rest position. FIG. 5 shows the shaving blade cartridge 10 in a rest position whereas FIG. 6 shows the shaving blade cartridge 10 in an upper end position. In the rest position, the shaving blade cartridge 10 may be free of constraints. For example, as represented in FIG. 5, in the rest position, the longitudinal axis X-X is sensibly orthogonal to the handle 12 direction (or the handle 12 direction of the proximal portion). The actuator 58 does not contact the handle 12. The free end of actuator 58 does not contact any part or portion of the razor. In the upper end position, such as described in FIG. 6, the shaving blade cartridge 10 may be forced in a position in which the free end of the actuator abuts against the handle 12. The upper end position allows accessibility to the trimming element 22. In the upper end position, a user-may easily trim.

The shaver 14 may also be provided with a locking device 66 securing the position of the shaving blade cartridge 10 in the upper end position. The locking device 66 may allow the upper end position to be a stable or non-moving position. The locking device 66 may maintain the shaving blade cartridge 10 in the upper end position with regard to the handle 12. The locking device 66 may maintain the shaving blade cartridge 10 in a non-moving position.

Such razor 14 may be used as follow, when the shaving blade cartridge 10 is mounted to the handle 12. The shaving blade cartridge 10 being in a rest position, the user may catch the handle 12 and approach the shaving blade cartridge 10 from his skin until a contact between the primary cutting elements 20 and the skin. The user may then shave in a usual way, using the primary cutting element 20. After or during shaving, when the user identifies areas that must be trimmed, he puts one finger on the actuator 58 which may define a finger rest area, and applies a force on the actuator 58 to urge the shaving blade cartridge 10 in the upper end position. By urging the shaving blade cartridge 10 in the upper end position the trimming element 22 becomes visible. The user may then use the trimming element 22. The upper end position may be stable with the locking device, such that no particular force or effort must be applied to maintain the position of the shaving blade cartridge 10 in the upper end position. There may be no need, with the present system, to turn the razor, or to adopt a particular position to have access to the trimming element 22. Thus, the user may fully exploit the handle design and gripping features of the handle, as there may no longer need to turn the handle around. The user has a full and constant visibility of the trimmer, which may allow for an improved maneuverability of the shaver. The trimming may take place directly after the shaving, without a totally different positioning of the handle or the cartridge.

The present system may allow for a continuity of the use of the shaver during shaving and trimming.

The invention claimed is:

1. A shaving blade cartridge comprising:

a housing extending longitudinally along a longitudinal axis, having a top side and a bottom side opposite to the top side, and first and second longitudinal sides, each of the first and second longitudinal sides extending longitudinally along the longitudinal axis between the top and bottom sides;

a primary cutting element mounted on the housing between the first and second longitudinal sides, the primary cutting element having a cutting edge facing forwardly toward the first longitudinal side and away from the bottom side;

a primary cover located rearward of the primary cutting element;

a primary guard located forward of the primary cutting element and;

a trimming element mounted on the housing, the trimming element having a trimming edge;

wherein the trimming element is located forward of the primary cutting element and of the cutting edge toward the first longitudinal side, and the trimming edge faces away from the second longitudinal side and toward the bottom side in a direction away from the first longitudinal side.

2. The shaving blade cartridge according to claim 1, wherein the trimming element is located under the primary guard.

3. The shaving blade cartridge according to claim 1, wherein the primary cutting element includes a cutting blade extending in a cutting blade plane, the trimming element includes a trimming blade extending in a trimming blade plane, and wherein the trimming blade plane crosses the cutting blade plane.

4. The shaving blade cartridge according to claim 1, wherein the primary guard includes fins.

5. The shaving blade cartridge according to claim 1, wherein the primary guard comprises a plastic material.

6. The shaving blade cartridge according to claim 1, wherein the primary guard comprises a metal material.

7. The shaving blade cartridge according to claim 6, wherein the trimming element is welded on the primary guard.

8. The shaving blade cartridge according to claim 1, wherein the trimming element includes a trimming blade support and a trimming blade, the trimming blade includes the trimming edge, and the trimming blade is supported by the trimming blade support.

9. The shaving blade cartridge according to claim 1, wherein the trimming blade is welded on the trimming blade support.

10. The shaving blade cartridge according to claim 1, wherein the shaving blade cartridge further includes a trimming cap, the trimming cap is located rearward of the trimming edge, the trimming cap and the primary guard is a one piece part.

11. The shaving blade cartridge according to claim 1, wherein the shaving blade cartridge further includes a trimming guard, the trimming guard is located forward of the trimming edge, the trimming guard is formed by the housing.

12. The shaving blade cartridge according to claim 1, further including an actuator, the actuator is located adjacent to the primary cover and defines a finger rest area.

13. The shaving blade cartridge according to claim 12, wherein the actuator extends from the housing.

* * * * *